US006473937B1

(12) United States Patent
Morawetz

(10) Patent No.: US 6,473,937 B1
(45) Date of Patent: Nov. 5, 2002

(54) MOTOR VEHICLE DOOR HINGE HAVING AN INTEGRATED BRAKING AND HOLDING FUNCTION

(75) Inventor: Richard Morawetz, Wuppertal (DE)

(73) Assignee: Ed. Scharwaechter GmbH, Remscheid (DE)

( * ) Notice: Subject to any disclaimer, the term of this patent is extended or adjusted under 35 U.S.C. 154(b) by 0 days.

(21) Appl. No.: 09/673,816

(22) PCT Filed: Jan. 28, 1999

(86) PCT No.: PCT/DE99/00256

§ 371 (c)(1),
(2), (4) Date: Jan. 17, 2001

(87) PCT Pub. No.: WO99/54582

PCT Pub. Date: Oct. 28, 1999

(30) Foreign Application Priority Data

Apr. 22, 1998 (DE) ..... 198 17 699

(51) Int. Cl.[7] ..... E05D 11/08

(52) U.S. Cl. ..... 16/337; 16/296; 16/386; 16/339; 16/327; 16/332

(58) Field of Search ..... 16/337, 335, 342, 16/341, 374, 296, 273, 82, 386, 339, 327, 332; 296/146.11, 146.12; 49/386

(56) References Cited

U.S. PATENT DOCUMENTS

| | | | | |
|---|---|---|---|---|
| 324,444 A | * | 8/1885 | Wolf | 16/322 |
| 2,992,451 A | | 7/1961 | Schonitzer | |
| 4,630,333 A | * | 12/1986 | Vickers | 16/342 |
| 5,867,869 A | * | 2/1999 | Garrett et al. | 16/332 |
| 5,918,347 A | * | 7/1999 | Morawetz | 16/322 |
| 6,073,308 A | * | 6/2000 | Linnenrbrink et al. | 16/334 |

FOREIGN PATENT DOCUMENTS

| | | |
|---|---|---|
| DE | 4406824 A1 | 9/1995 |
| DE | 0816610 A2 | 1/1998 |

* cited by examiner

*Primary Examiner*—Chuck Y. Mah
(74) *Attorney, Agent, or Firm*—Davidson, Davidson & Kappel, LLC

(57) ABSTRACT

The invention relates to a motor vehicle door hinge having an integrated braking and holding function. Said door hinge is comprised of a first hinge half which acts upon a door assembly part, a door, or a door pillar, and of a second hinge halve which acts upon another door assembly part. The door hinge also comprises a hinge pin which pivotally connects both hinge halves to one another. The hinge pin is made of a solid material and is accommodated in at least one hinge eye of a hinge half with a running fit and is accommodated in at least one hinge eye of the other half with a close fit. A braking and holding device which is integrated in the hinge comprises at least one spring-loaded braking and holding body. Said braking and holding body is aligned in a radial manner relative to the hinge pin and interacts with a circumferential profile of the hinge pin, said profile extending over a part of the circumference thereof. The aim of the invention is to obtain an increasing braking of the opening movement of the doors over a predetermined permitted opening angle of the doors, and inversely to obtain a progressively easier closing movement of the doors. To this end, the circumferential profile of the hinge pin which extends over a part of the circumference thereof forms a braking ramp comprising a contour which continuously increases in the door opening direction. In addition, the braking and holding body which interacts with said braking ramp is configured as a friction body.

17 Claims, 3 Drawing Sheets

MOTOR VEHICLE DOOR HINGE HAVING AN INTEGRATED BRAKING AND HOLDING FUNCTION

FIELD OF THE INVENTION

The present invention relates to a motor vehicle door hinge with integrated braking and holding function, including a first hinge half fastenable to one door arrangement part, namely door or door pillar, and a second hinge half fastenable to the other door arrangement part and also a hinge pin pivotably connecting the two hinge halves to one another, the hinge pin consisting of a solid material and being arranged in at least one hinge lug of one hinge half with a running fit, but in at least one hinge lug of the other hinge half with a firm fit, and a braking and holding device integrated into the hinge comprising at least one spring-loaded braking and holding body and which co-operates with a circumferential hinge-pin profiling extending over part of the circumference of said hinge Din and which is oriented radially to the hinge pin.

BACKGROUND INFORMATION

The aim of such or comparably designed integration of a braking and holding function into a motor vehicle door hinge is to provide a small-size combination of door stop and door hinge which is suitable for exerting high braking and holding forces and which is distinguished by the utilization of parts present in any case in the hinge and by the smallest possible number of components and the simplest possible mountability.

A motor vehicle door hinge of the abovementioned type with integrated braking and holding function is known, for example, from European Patent application No. EP-A 0 816 610 and is distinguished essentially in that the braking and holding function is formed as a whole from a cylinder housing connected fixedly in terms of rotation to one of the door arrangement parts and from a cylinder plug received in the cylinder housing and connected fixedly in terms of rotation to the other door arrangement part and also from at least one braking and holding body arranged radially adjustably in one part, namely a cylinder housing or cylinder plug, the cylinder plug being formed by a length portion of the hinge pin. Although such accommodation of the braking and holding device in a closed cylinder housing ensures not only small-size execution and assignment, but also an absolutely leak-tight design of the door stop, so that any impairment of the braking and holding functions of the door stop due to the painting of the vehicle body and a subsequent escape of abrasion or other dirt possibly occurring during operation are both ruled out, nevertheless, on the other hand, it has the disadvantage that the door cannot be stopped in a step-free manner and there is therefore the risk that noise would be generated during operation. Moreover, the known braking and holding device necessitates the production and mounting of a multiplicity of individual parts and is therefore relatively complicated.

Furthermore, in order to achieve continuous braking and step-free stopping of the vehicle door in motor vehicle door hinges with an integrated braking and holding function, it has already also been proposed to secure the hinge pin fixedly in terms of rotation in the hinge lug or hinge lugs of a first hinge half and to equip it, over its length passing through the hinge lug of the other hinge half in which it is to have a running fit, with at least one radially ascending wedge surface and to assign to the latter at least one wedge surface radially ascending on the inner circumference of the hinge-lug bore of the associated hinge lug of the second hinge half, in which case the two wedge surfaces must have identical pitches such that they form pairs of wedge surfaces which, over their entire overlap region, bear on one another essentially over a large area German Patent No. (DE-C 44 06 824). Although this configuration of a braking and holding device has the attractive benefit that no additional components are necessary to implement it and that, furthermore, the overall size of the hinge is not influenced or is influenced only insignificantly, it nevertheless has the disadvantage that, to achieve the desired braking and holding action, the wedge surfaces must have, on the one hand, a wedge surface ascending at a very low angle and, on the other hand, a flank surface descending at a steep angle, thus resulting in a considerable outlay in production terms both for the hinge pin and for the hinge-lug bore, particularly because the mutually co-operating wedge surfaces on the hinge pin, on the one hand, and on the inner circumference of the hinge-lug bore, on the other hand, have to be manufactured with the highest possible precision which can scarcely be achieved in mass production. Insofar as the criterion of highest possible precision is not fulfilled or is fulfilled only inadequately, either a sufficient inhibiting action cannot be achieved or premature wear occurs.

SUMMARY OF THE INVENTION

The object on which the present invention is based is to improve a door stop capable of being integrated into a door hinge and, at the same time, a, in particular, demountable motor vehicle door hinge equipped with an integrated door stop, to the effect that the door stop as a whole is designed to have as small a size as possible, even in the case of a maximum door opening angle of up to 270°, and has a closed design in the same way, and that, furthermore, the holding forces of the door stop are adjustable, even subsequently, at any desired moment and with regard to the mounting of the hinge or stop on the vehicle body, and adjustability is to be afforded, irrespective of whether the door stop is designed to be integrated into a door hinge or as a stop independent of the door hinges.

The object on which the present invention is based is, therefore, to provide a motor vehicle door hinge with integrated braking and holding function, which, whilst having the simplest possible form of construction, ensures, over a predetermined permitted opening angle of the door, an increasing braking of the opening movement of the door and, conversely, an increasingly easier closing movement of said door and at a selected opening angle contains a limit stop for the motor vehicle door and, furthermore, in which, on the one hand, the painting of the vehicle body cannot lead to any impairment in functioning and, on the other hand, the operation of a vehicle door or the operating mode of the door stop cannot lead to any paint or dirt abrasion.

Proceeding from a motor vehicle door hinge of the type described in the introduction, this object is may be achieved, according to the present invention, in that the circumferential hinge-pin profiling extending over part of the circumference of said hinge pin forms a braking ramp having a contour profile continuously ascending in the door opening direction and the braking and holding body co-operating with said braking ramp is designed as a frictional body, This configuration of a braking and holding device is distinguished, in the first place, in that, in order to implement it on or as integrated into a motor vehicle door hinge, it is necessary, in principle, to have only two additional parts, specifically the braking and holding body and a loading spring. At the same time, the design according to the present invention of a braking and holding device integrated into a door hinge makes it possible to exert continuously rising or falling braking and holding forces, with the obvious possibility of being able to adapt these in a simple way, without additional outlay, to any desired profile of force rise or of force fall by the configuration or modification of the contour shape of the braking ramp. Since, in the braking and holding device designed according to the present invention, the braking forces are exerted and supported solely within a hinge lug, such a braking and holding device is also suitable for use in conjunction with any desired type of door hinges, that is to say both single-shear and double-shear door hinges. Furthermore, the braking and holding device according to the present invention allows a wide range of different embodiments which, on the one hand, are adaptable to the respective hinge shape or hinge type and, on the other hand, can be designed according to the necessary braking forces.

In a simple and preferred embodiment, there is provision for the braking ramp to be formed in the bottom of a radial hinge-pin recess extending over part of the circumference of said hinge pin, the radial hinge-pin recess which contains the braking ramp being arranged within that region of said hinge pin which passes through the or one of the hinge lugs in which it has a running fit and extending over part of the height of the hinge lug and only over a circumferential hinge-pin region corresponding to the permitted maximum opening angle of the door.

In order to ensure a reliable limitation of the maximum door opening angle, there is provision, further, for the radial hinge-pin recess which contains the braking ramp to be delimited in the door opening direction by an opening limit stop co-operating with the braking and holding body, the opening limit stop which co-operates with the braking and holding body being formed advantageously by a stop strip inserted into the radial hinge-pin recess which contains the braking ramp.

In a further configuration of the preferred embodiment of a motor vehicle door hinge equipped with an integrated braking and holding device, there is expediently provision, further, for the braking and holding body to be received radially relative to the hinge pin in the hinge half containing that hinge lug in which the hinge pin has a running fit and to be acted upon by a spring load in the direction of the hinge pin. In this respect, a favourable individual embodiment is seen in that the braking and holding body has a height corresponding at least approximately to the height of the radial hinge-pin recess.

With a view to a small-size accommodation of the braking and holding device within the hinge, there is provision for the braking and holding body to have a rectangular cross-section and shape and to be received longitudinally displaceably, on edge, in a pocket-like recess, issuing into the hinge lug, of the hinge plate of that hinge half in the hinge lug of which the hinge pin has a running fit.

In conjunction with such a design and accommodation of a braking and holding body, a preferred feature of the present invention provides, furthermore, for a loading spring assigned to the braking and holding body to be designed as a helical spring and, in an arrangement oriented axially parallel to the hinge axis, on the one hand, to be supported against a cover closing the pocket-like recess in the hinge plate and, on the other hand, to engage by means of a force deflection device on that end of the braking and holding body which faces away from the hinge pin. In this case, an embodiment, capable of being implemented and mounted without high outlay, of the force deflection device assigned to the loading spring designed as a helical spring is obtained in that the deflection is formed by a wedge body which is acted upon by the loading spring and which, on the one hand, is supported against a back surface, inclined relative to the hinge axis, of the pocket-like recess and engages on the smooth-surface rear side of the braking and holding body, said rear side being oriented parallel to the hinge axis.

For the purpose of integrating the braking and holding device into the hinge as far as possible, in a further embodiment of the present invention there is also expediently provision for closing off by means of a cover part the pocket-like recess, receiving the braking and holding body and oriented radially to the hinge axis, of the pivotable hinge half, a screw bolt assigned to the fastening of the cover part at the same time passing through a bore recess in the braking and holding body, said bore recess expediently being designed as an oversize bore.

An action which is virtually completely wear-free and silent over the lifetime of the hinge and therefore of the braking and holding device is achieved, in a braking and holding device of the preferred embodiment, essentially in that the hinge mounting and the braking and holding device arranged in the latter are equipped with once-only lifetime lubrication. For this purpose, according to an expedient individual embodiment, a door hinge configuration suitable for ensuring such lifetime lubrication provides for there to be formed on the hinge pin, in conjunction with a hood-like design, engaging over the hinge pin, of the hinge lug of the hinge half pivotable relative to the hinge pin and containing the braking and holding body, a radially projecting collar which engages over the open side of the hinge lug, and for the hinge lug, engaging in a hood-like manner over the hinge pin, of the pivotable hinge half to be sealed off by means of a sealing disc inserted between its open end face and the radially projecting collar of the hinge pin.

However, in a modified configuration of the design according to the invention of braking and holding devices, said configuration being assigned to achieving non-linearly rising braking forces or non-linearly falling closing forces of a braking and holding device integrated into a door hinge, there may also be provision for the braking ramp formed in the bottom of a radial hinge-pin recess extending over part of the circumference of said hinge pin to have a discontinuous pitch from its end assigned to the closing position of the door to its end assigned to the opening end position of the door.

Finally, an advantageous development of a door hinge equipped with a braking and holding device according to the present invention may also be distinguished in that the rotationally fixed securing of the hinge pin to the other hinge half is assigned an essentially hood-like hinge lug of the other hinge half, said hinge lug receiving an associated length portion of the hinge pin and being equipped with a Hirth-type serration, and a screw holding the Hirth-type serration in engagement and passing through the end wall of the hood-shaped hinge lug.

The present invention is described in detail in the following example description by means of an exemplary embodiment illustrated in the drawing in which:

DETAILED DESCRIPTION OF THE DRAWINGS

Figure 2:
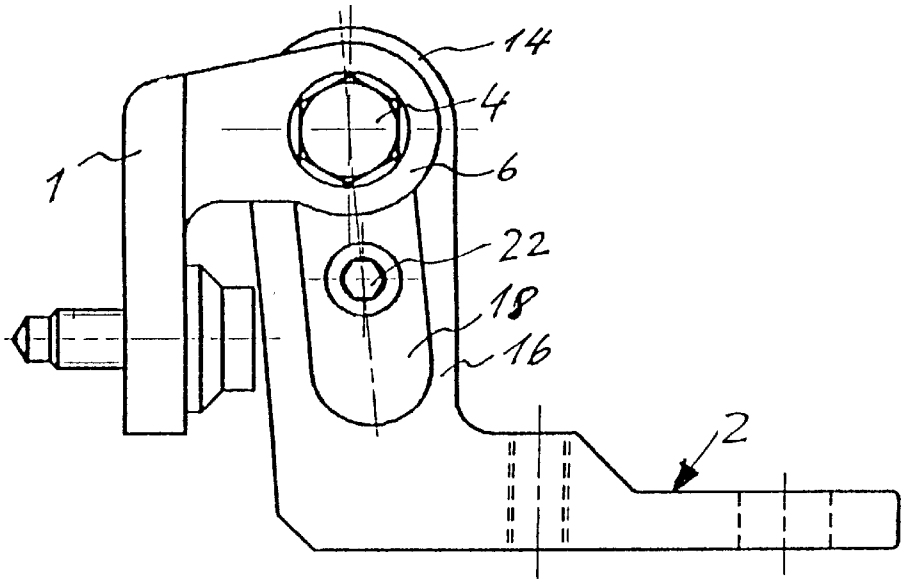
FIG. 2 shows a top view of a hinge according to FIG. 1.
Figure 1:
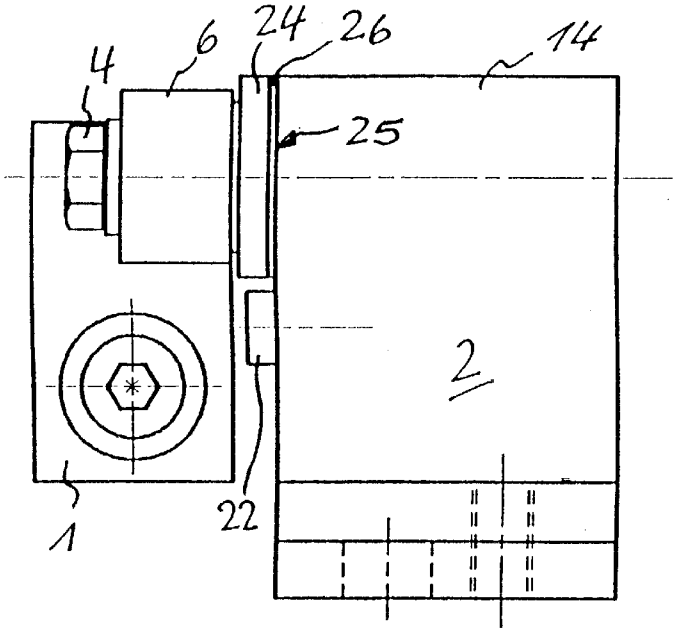
FIG. 1 shows a side view of a door hinge equipped with an integrated braking and holding device.
Figure 4:
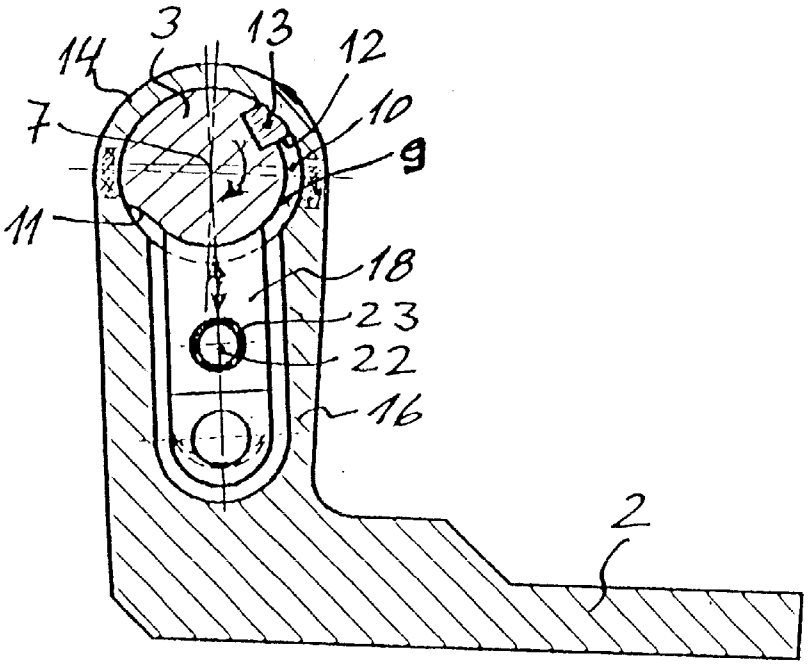
FIG. 4 shows a cross section through the door hinge along the line IV–IV in FIG. 1.
Figure 3:
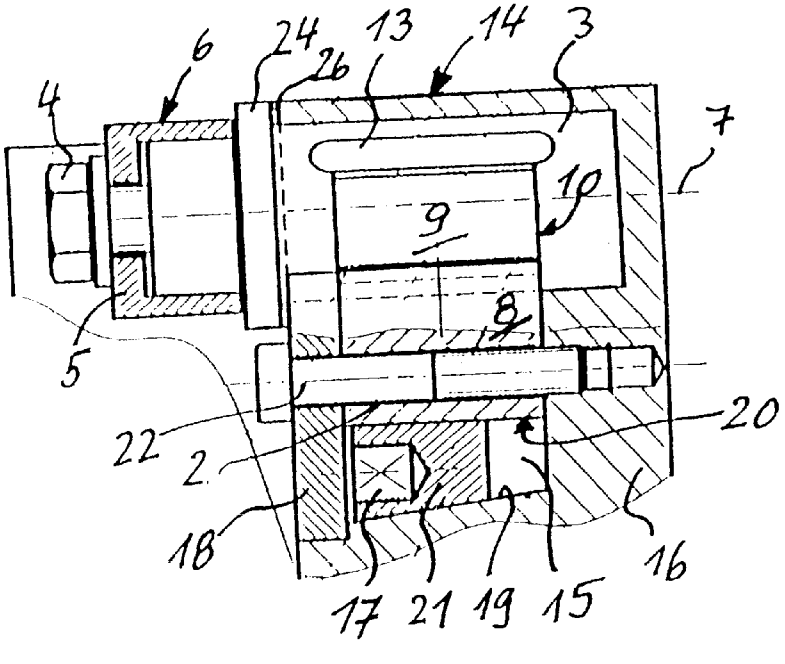
FIG. 3 shows a longitudinal section through the hinge along the line III—III in FIG. 2.

In the embodiment of FIGS. 1 through 4 of a braking and holding device, as shown in the exemplary embodiment and as integrated into a door hinge, the door hinge include a first hinge half 1 to be fastened to one door arrangement part and a second hinge half 2 to be fastened to the other door arrangement part and also hinge pin 3. The hinge pin 3 is, in this case, braced by means of a screw bolt 4 passing through it against the bottom surface 5 of a hinge lug 6 of the hinge half 1, said hinge lug being approximately bowl-shaped as a whole. For connecting the hinge pin 3 fixedly in terms of rotation to the hinge half 1, the hinge lug 6 is provided on the inside with a Hirth-type serration and the hinge pin 3 has a complementary profiling over part of its engagement length. The braking and holding device comprises a braking and holding body 8, which is arranged so as to be oriented radially to the hinge axis 7 and is received in the hinge half 2 displaceably in a plane oriented radially to the hinge pin 3 and which is spring-loaded in the direction of the hinge axis 7, and a braking ramp 9 formed on the hinge pin 3. The braking ramp 9 is formed at the bottom of a radial recess 10 in the hinge pin 3 and, in the embodiment shown, has a contour ascending continuously from its end 11 assigned to the closing position of the door to the opening limit stop 12 assigned to the maximum door opening angle. In the embodiment shown, the opening limit stop is reinforced or formed by a stop strip 13 inserted into the hinge pin 3. The braking and holding body 8, designed as a frictional body has a rectangular cross-sectional shape and a height corresponding at least approximately to the height of the radial recess 10 in the hinge pin 3 and is received longitudinally displaceably as a whole in a pocket-like recess 15, issuing into the hinge lug 14, in the hinge plate 16 of the hinge half 2 in the hinge lug 14 of which the hinge pin 3 has a running fit and is acted upon by a spring load in the direction of the hinge pin 3. A loading spring 17 assigned to the braking and holding body 8 is designed as a helical spring and, in an arrangement oriented axially parallel to the hinge axis 7, on the one hand, is supported against a cover 18 closing the pocket-like recess 15 in the hinge plate 16 and, on the other, hand, engages by means of a force deflection device on that end of the braking and holding body 8 which faces away from the hinge pin. In the embodiment shown, the force deflection device assigned to the loading spring 17 designed as a helical spring is formed by a wedge body 21 which is acted upon by the loading spring 17 and, on the one hand, is supported against a back surface 19, inclined relative to the hinge axis 7, of the pocket-like recess 15 and, on the other hand, engages on the smooth-surface rear side 20 of the braking and holding body 8, said rear side being oriented parallel to the hinge axis 7.

A screw bolt 22 assigned to the fastening of the cover 18 on the end face of the hinge plate 16 at the same time passes through an oversized bore recess 23 in the braking and holding body 8 and thus serves for simplifying the mounting of the braking and holding device. The hinge lug 14 of the hinge half 2 pivotable relative to the hinge pin 3 has a hood-like design engaging over the hinge pin 3. Furthermore, there is formed on the hinge pin 3 a radially projecting collar 24 which engages between the two hinge lugs 6 and 14 of the two hinge halves 1 and 2 and on which the open side 25 of the hinge lug 14, engaging in a hood-like manner over the hinge pin 3, of the pivotable hinge half 2 is sealed off by means of a sealing disc 26 inserted between the open end face 25 of said hinge lug and the radially projecting collar 24 of the hinge pin 3. Further more, the hinge mounting and the braking and holding device arranged in the latter are equipped with once-only lifetime lubrication which cannot be seen in detail from the drawing.

Figure 5:
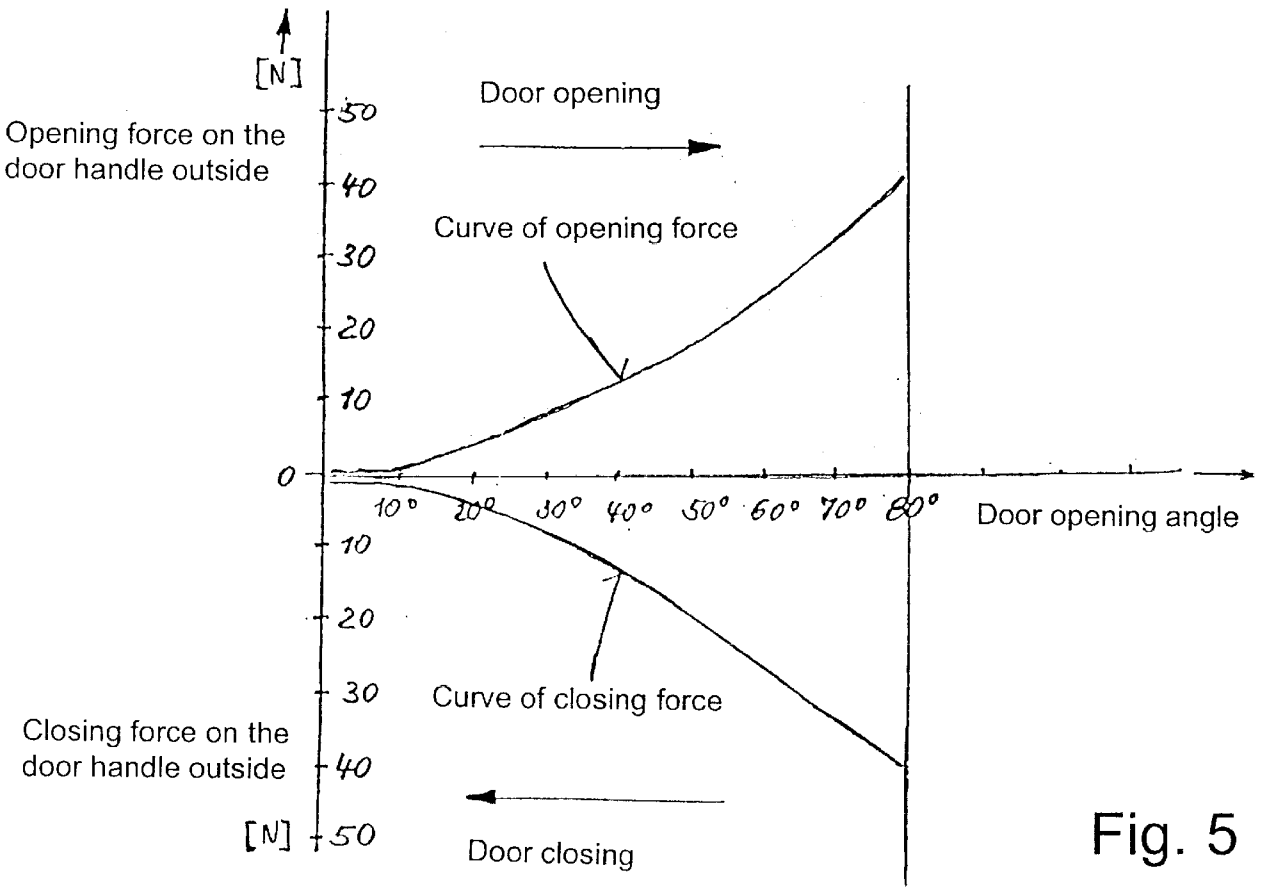
FIG. 5 shows a graphical illustration of the profile of the braking force against the door opening angle.

The graphical illustration, shown in figure 5 of the profile of the braking forces exerted over the door opening angle by the above-described embodiment of a braking and holding device make it clear, in particular, that, even in the case of a rectilinear and continuously and uniformly ascending design of the pitch of the braking ramp of the braking and holding device, a superproportional rise in the braking forces in the door opening direction can be achieved with an increasing door opening angle. Furthermore, the graphical illustration indicates that, during the closing of the door, the braking forces exerted by the braking and holding device initially fall very quickly from a maximum value assigned to the opening end position of the door, thus increasing the ease with which the door is operated.

What is claimed is:

1. A motor vehicle door hinge with integrated braking and holding function, comprising:

a first hinge half fastenable to one of a door and a door pillar, a second hinge half fastenable to the other of said door and said door pillar, a hinge pin pivotably connecting said first hinge half with said second hinge half, said hinge pin being a solid material and being arranged with a running fit in at least one hinge lug of one of said first hinge half and said second hinge half and with a firm fit in at least one other hinge lug of the other of said first hinge half and said second hinge half, and a braking and holding arrangement integrated into the hinge, comprising a circumferential hinge-pin profiling extending over part of the circumference of said hinge pin, at least one braking and holding body displaceable radially with respect to said-hinge pin, and a spring urging an end face of said braking and holding body into frictional contact with said hinge pin profiling, wherein said hinge-pin profiling defines an ascending profile such that the holding force of the hinge increases in an opening direction of the hinge and decreases in a closing direction of the hinge.

2. The motor vehicle door hinge according to claim 1, wherein the hinge pin profiling is formed in a bottom of a radial hinge-pin recess extending over part of the circumference of said hinge pin.

3. The motor vehicle door hinge according to claim 2, wherein the radial hinge-pin recess which contains the hinge pin profiling is arranged within that length region of said hinge pin which passes through said at least one hinge lug in which said hinge pin has a running fit and extends only over part of said at least one hinge lug and only over a circumferential hinge-pin region corresponding to the permitted maximum opening angle of the hinge.

4. The motor vehicle door hinge according to claim 2, wherein the radial hinge-pin recess is delimited in the door opening direction by an opening limit stop co-operating with the braking and holding body.

5. The motor vehicle door hinge according to claim 4, wherein the opening limit stop is formed by a stop strip inserted into the radial hinge-pin recess.

6. The motor vehicle door hinge according to claim 2, wherein the braking and holding body has a height corresponding at least approximately to the height of the radial hinge-pin recess.

7. The motor vehicle door hinge according to claim 1, wherein the braking and holding body has a rectangular cross-sectional shape and is received, on edge, adjustably radially to the hinge pin in the hinge half containing that hinge lug in which the hinge pin has a running fit.

8. The motor vehicle door hinge according to claim 1, wherein the braking and holding body is received in a pocket-like recess issuing into the hinge lug of a hinge plate of that hinge half in the hinge lug of which the hinge pin has a running fit.

9. The motor vehicle door hinge according to claim 8, wherein a loading spring assigned to the braking and holding body is designed as a helical spring and, in an arrangement oriented axially parallel to the hinge axis, on the one hand, is supported against a cover part closing the pocket-like recess in the hinge plate of the hinge half and, on the other hand, engages using a force deflection device on an end of the braking and holding body which faces away from the hinge pin.

10. The motor vehicle door hinge according to claim 9, wherein the force deflection device is formed by a wedge body that is supported against a back surface, inclined relative to the hinge axis, of the pocket-like recess and engages on a smooth-surface rear side of the braking and holding body, said rear side being oriented parallel to the hinge axis.

11. The motor vehicle door hinge according to claim 10, wherein a screw bolt assigned to the fastening of the cover part is at the same time passing through a bore recess in the braking and holding body, said bore recess being designed preferably as a long-hole recess and allowing at least a play of the braking and holding body in the radial direction of the hinge pin.

12. The motor vehicle door hinge according to claim 1, wherein a radially projecting collar is formed on the hinge pin which engages over an open side of a hinge lug of said one of said first hinge half and said second hinge half.

13. The motor vehicle door hinge according to claim 12, wherein the hinge lug is sealed off by a sealing disc inserted between the open end face of said hinge lug and the radially projecting collar of the hinge pin.

14. The motor vehicle door hinge according to claim 12, wherein the hinge lug is equipped with once-only lifetime lubrication.

15. The motor vehicle door hinge according to claim 1, wherein the hinge-pin profiling formed in the bottom of a radial hinge-pin recess extending over part of the circumference of said hinge pin has a non-linear pitch from an end assigned to a closing position of the door to an other end assigned to an opening end position of the door.

16. The motor vehicle door hinge according to claim 1, wherein the rotationally fixed securing of the hinge pin to said other hinge half is assigned a hinge lug of said other hinge half, said hinge lug of said other hinge half receiving an associated length portion of the hinge pin and being equipped with a Hirth-type serration, and wherein a screw holds the Hirth-type serration in engagement and passes through the end wall of the hood-shaped hinge lug.

17. A motor vehicle door hinge with integrated braking and holding function, comprising:

a first hinge half fastenable to one of a door and a door pillar, a second hinge half fastenable to the other of said door and said door pillar, a hinge pin pivotably connecting said first hinge half with said second hinge half, said hinge pin being a solid material and being arranged with a running fit in at least one hinge lug of one of said first hinge half and said second hinge half and with a firm fit in at least one other hinge lug of the other of said first hinge half and said second hinge half, a braking and holding arrangement integrated into the hinge, comprising a circumferential hinge-pin profiling extending over part of the circumference of said hinge pin, at least one braking and holding body displaceable radially with respect to said-hinge pin and having a first end face and a second end face opposite the first end face, and a spring urging the first end face of said braking and holding body into frictional contact with said hinge pin profiling, and a wedge body, said spring being loaded against a first surface of the wedge body, said wedge body having a second surface being in contact with the second end face of the braking and holding body, and a third surface inclined with respect to said second surface and with respect to said first surface, said second surface and said third surface defining an acute angle, wherein said third surface is in contact with an inclined portion of a recess of a hinge plate of one of said first hinge half and said second hinge half receiving the braking and holding body and the wedge body so that the wedge body is urged towards said acute angle thus forcing the braking and holding body towards the hinge pin.

* * * * *